US010823473B2

(12) United States Patent
West

(10) Patent No.: US 10,823,473 B2
(45) Date of Patent: Nov. 3, 2020

(54) OPTIMIZING ENERGY EFFICIENCY RATIO FEEDBACK CONTROL FOR DIRECT EXPANSION AIR-CONDITIONERS AND HEAT PUMPS

(71) Applicant: Advantek Consulting Engineering, Inc., Melbourne, FL (US)

(72) Inventor: Michael Kenneth West, Melbourne, FL (US)

(73) Assignee: Advantek Consulting Engineering Inc., Melbourne, FL (US)

( * ) Notice: Subject to any disclaimer, the term of this patent is extended or adjusted under 35 U.S.C. 154(b) by 96 days.

(21) Appl. No.: 15/824,088

(22) Filed: Nov. 28, 2017

(65) Prior Publication Data

US 2018/0080695 A1 Mar. 22, 2018

Related U.S. Application Data

(63) Continuation of application No. 15/436,942, filed on Feb. 20, 2017, now Pat. No. 9,958,190, which is a (Continued)

(51) Int. Cl.
*F25B 49/02* (2006.01)
*F25B 49/00* (2006.01)

(52) U.S. Cl.
CPC ..... *F25B 49/02* (2013.01); *F25B 49/00* (2013.01); *F25B 2400/0411* (2013.01); (Continued)

(58) Field of Classification Search
CPC ..... F25B 2600/2513; F25B 2500/19; F25B 2700/21151; F25B 49/02; F25B 13/00; (Continued)

(56) References Cited

U.S. PATENT DOCUMENTS 4,325,223 A * 4/1982 Cantley ..... G05D 23/1917 62/126
4,327,559 A * 5/1982 Spethmann ..... G05D 23/1917 62/179

(Continued)

*Primary Examiner* — William V Gilbert
(74) *Attorney, Agent, or Firm* — Brian S. Steinberger; Hilary F. Steinberger; Law Offices of Brian S. Steinberger, P.A.

(57) ABSTRACT

A system for maximizing the measured efficiency of an HVAC&R system may include the steps of (1) providing a plurality of operating parameters selected from the group consisting of condenser fan speed, evaporator fan speed, inlet solenoid valve position, outlet solenoid valve position, and compressor control to the air conditioner or the heat pump system wherein each of the plurality of operating parameters has a respective operating parameter value; (2) calculating an initial efficiency of the system using signals received from a plurality of components selected from the group consisting of a temperature sensor, a humidity sensor, a pressure sensor, a flow sensor, a voltage sensor, and a current sensor; and (3) proceeding, starting with a first of the plurality of operating parameters, to iteratively adjust values of each of the plurality of operating parameters and accept the new values only if the measured efficiency increases.

8 Claims, 6 Drawing Sheets

Related U.S. Application Data continuation-in-part of application No. 14/162,424, filed on Jan. 23, 2014, now Pat. No. 9,574,810.

(60) Provisional application No. 61/756,017, filed on Jan. 24, 2013.

(52) U.S. Cl.
CPC ... *F25B 2400/0415* (2013.01); *F25B 2400/16* (2013.01); *F25B 2500/18* (2013.01); *F25B 2500/19* (2013.01); *F25B 2600/2501* (2013.01); *F25B 2600/2523* (2013.01); *F25B 2700/1332* (2013.01); *F25B 2700/15* (2013.01); *F25B 2700/195* (2013.01); *F25B 2700/1931* (2013.01); *F25B 2700/1933* (2013.01); *F25B 2700/21151* (2013.01); *F25B 2700/21152* (2013.01); *F25B 2700/21161* (2013.01); *F25B 2700/21163* (2013.01); *F25B 2700/21172* (2013.01)

(58) Field of Classification Search
CPC ..... G01R 19/2513; G01F 25/0007; G01F 115/024
USPC ..... 702/182; 62/190, 203
See application file for complete search history.

(56) References Cited

U.S. PATENT DOCUMENTS

| | | | | | |
|---|---|---|---|---|---|
| 4,611,470 | A * | 9/1986 | Enstrom | F25B 49/02 | 62/127 |
| 4,873,649 | A * | 10/1989 | Grald | F25B 49/02 | 700/276 |
| 5,623,834 | A * | 4/1997 | Bahel | F25B 49/005 | 62/131 |
| 5,979,167 | A * | 11/1999 | Kochavi | F24F 3/044 | 62/186 |
| 6,293,108 | B1 * | 9/2001 | Cho | F25B 6/04 | 62/5 |
| 7,000,413 | B2 * | 2/2006 | Chen | F25B 9/008 | 62/190 |
| 7,472,557 | B2 * | 1/2009 | Kang | F25B 45/00 | 62/127 |
| 8,056,348 | B2 * | 11/2011 | Murakami | F25B 45/00 | 62/174 |
| 8,272,227 | B2 * | 9/2012 | McMasters | F25B 45/00 | 62/77 |
| 10,281,938 | B2 * | 5/2019 | Mowris | F24H 9/2071 | |
| 2006/0032245 | A1 * | 2/2006 | Kates | F24F 3/1603 | 62/129 |
| 2009/0171512 | A1 * | 7/2009 | Duncan | F24F 5/0035 | 700/300 |
| 2014/0262134 | A1 * | 9/2014 | Arensmeier | F24D 19/1084 | 165/11.2 |

* cited by examiner

OPTIMIZING ENERGY EFFICIENCY RATIO FEEDBACK CONTROL FOR DIRECT EXPANSION AIR-CONDITIONERS AND HEAT PUMPS

RELATED APPLICATIONS

This application is a continuation and claims the benefit under 25 U.S.C § 120 of U.S. application Ser. No. 15/436,942 filed on Feb. 20, 2017 and titled Optimizing Energy Efficiency Ratio Feedback Control for Direct Expansion Air-Conditioners and Heat Pumps, which is a continuation-in-part and claims the benefit under 35 U.S.C. § 120 of U.S. application Ser. No. 14/162,424 filed on Jan. 23, 2014 and titled Optimizing Energy Efficiency Ratio Feedback Control for Direct Expansion Air-Conditioners and Heat Pumps and claims the benefit under 35 U.S.C. § 119(e) of U.S. Provisional Patent Application Ser. No. 61/756,017 filed on Jan. 24, 2013 and titled EER Meter and Optimizing Feedback Control for DX Air-Conditioners, the entire contents of which are incorporated herein by reference.

This application is also related to U.S. Pat. No. 9,261,542 issued on Feb. 16, 2016 and titled Energy Efficiency Ratio Meter for Direct Expansion Air-Conditioners and Heat Pumps, the entire contents of which are incorporated herein by reference.

FIELD OF THE INVENTION

The present invention relates to systems and methods for measuring and improving efficiency of heating, ventilation, air conditioning, and refrigeration (HVAC&R) equipment. It specifically addresses optimization of the cooling or heating capacity relative to the power usage and a system to continuously maximize the measured efficiency under actual operating conditions.

BACKGROUND

The thermodynamic method used in nearly all air conditioners, refrigerators and heat pumps is the vapor compression cycle also called the refrigeration cycle. The basic cycle uses four primary components: a compressor, a condenser, an expansion device, and an evaporator. Some systems may use additional components such as a receiver, additional heat exchangers, two or more compressors, an accumulator, other specialized components, such as, but not limited to, a liquid vapor separator, a vortex separator, a surge tank, refrigerant reservoir, or vessel. The four primary components are piped in series to form a closed loop system that carries out the changes in temperature, pressure, and state of the working fluid, which may be refrigerant, which forms the basic vapor compression cycle. Furthermore, within air conditioners, refrigerators, and heat pumps, outside of the refrigeration cycle there are typically ancillary components that move the desired heat transfer medium, such as the blowing of air or of flowing of water that is to be cooled or heated. The heat transfer medium may be moved across the primary heat exchangers, which are the condenser coil and the evaporator coil. In addition, there is typically a control circuit that energizes and de-energizes the driven components, including the compressor, fan motors, pump motors, damper actuators, and valves. The driven components are energized or de-energized to meet a desired temperature, ventilation, humidity or other set point or operating parameters.

The efficiency of vapor compression cycles is numerically described by an energy efficiency ratio (EER) or a coefficient of performance (COP). The EER generally refers to the air conditioning, refrigerating, or heating system and is the ratio of the heat absorbed by the evaporator cooling coil over the input power to the equipment, or conversely for heat pumps, the rate of heat rejected by the condenser heating coil over the input power to the equipment. EER is defined as the ratio of cooling or heating provided to electric power consumed, in units of Btu per hour per watt. EER varies greatly with cooling load, refrigerant level, and airflow, among other factors. The COP generally refers to the thermodynamic cycle and is defined as the ratio of the heat absorption rate from the evaporator over the rate of input work provided to the cycle, or conversely, for heat pumps, the rate of heat rejection by the condenser over the rate of input work provided to the cycle. COP is a unit-less numerical ratio.

In addition, there is a standard weighted average of EER at four conditions known as the integrated energy efficiency ratio (IEER), which relates to an estimation of the energy efficiency over conditions experienced during a cooling season. Also, there is the seasonal energy efficiency ratio (SEER) that is used instead of the IEER for smaller air conditioning units. Either lowering capacity or increasing power manifest in reduced energy efficiency and a reduced EER, COP, IEER, or SEER. Increasing capacity without increasing power, or reducing power without decreasing capacity, or both increasing capacity and reducing power will manifest in an increased EER, COP, IEER, or SEER.

An energy management system for refrigeration systems is disclosed by Cantley (U.S. Pat. No. 4,325,223) and relies on inference of energy efficiency rather than a direct measurement. The inference is based on relative comparison of compressor power data and other system parameters stored in memory. The system of Cantley does not make control adjustments according to the system energy efficiency ratio, rather it controls evaporative cooling.

A system disclosed by Spethmann (U.S. Pat. No. 4,327,559) applies only to chilled water systems. The disclosure of Spethmann balances the trade-off between colder chilled water and faster fan airflow using ratio relays.

A method disclosed by Enstrom (U.S. Pat. No. 4,611,470) also applies only to chilled water systems. The method of Enstrom is for performance control of heat pumps and refrigeration equipment and depends on the chilled water temperature.

A system disclosed by Bahel, et al. (U.S. Pat. No. 5,623,834) is directed to diagnostics and fault correction. Only the fan speed and thermostatic expansion valve are controlled based on a relative comparison of two temperatures and the thermal load calculated via a thermostat.

Cho, et. al (U.S. Pat. No. 6,293,108) discloses methods for separating components of refrigerant mixtures to increase energy efficiency or capacity.

Chen, et al. (U.S. Pat. No. 7,000,413) discloses control of a refrigeration system to optimize coefficient of performance (COP), but there is no description of how the COP is determined. Chen discloses adjusting COP to achieve a reference COP stored in memory and does not optimize the COP. The primary application of Chen, et al, is transcritical systems using carbon dioxide refrigerant. Chen, et al. does not disclose an embodiment for measurement of the refrigerant flow rate. Chen, et al. discloses only adjusting the water flow rate and the expansion valve.

Automatic refrigerant charge adjustment methods are disclosed by Kang, et al. (U.S. Pat. No. 7,472,557), Murakami, et al. (U.S. Pat. No. 8,056,348), and McMasters, et al. (U.S. Pat. No. 8,272,227). These references disclose methods to adjust a charge to match published charging tables, reference temperatures, or pressure values.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a method of maximizing the measured efficiency of an air conditioner or a heat pump system having a condenser, an evaporator, a compressor, and an expansion device. The method may include the steps of: (1) providing a plurality of operating parameters selected from the group consisting of condenser fan speed, evaporator fan speed, inlet solenoid valve position, outlet solenoid valve position, and compressor control to the air conditioner or the heat pump system wherein each of the plurality of operating parameters has a respective operating parameter value; (2) calculating an initial efficiency of the system using signals received from a plurality of components selected from the group consisting of a temperature sensor, a humidity sensor, a pressure sensor, a flow sensor, a voltage sensor, and a current sensor; and (3) proceeding, starting with a first of the plurality of operating parameters as an active operating parameter having an initial active operating parameter value, to (a) adjust the initial active operating parameter value to a new operating parameter value, (b) calculate a measured efficiency of the system, (c) compare the initial efficiency of the system to the measured efficiency of the system, and (d) allow the new active operating parameter value to act as the initial operating parameter value if the measured efficiency of the system is improved beyond a predetermined threshold, in an iterative manner with the measured efficiency of the system acting as an initial efficiency for the next iteration and a next of the plurality of operating parameters acting as the active operating parameter in the next iteration until each of the plurality of operating parameters have been the active operating parameter.

The method may include the steps of (1) adjusting the active operating parameter value in an opposite direction to the new operating parameter value if the measured efficiency of the system is not improved; (2) calculating the measured efficiency of the system; and (3) reverting the active operating parameter value to the initial active operating parameter value if the measured efficiency of the system is decreased.

The method may include the steps of (1) utilizing a measurement from a first temperature sensor in thermal communication with fluid entering the evaporator; (2) utilizing a measurement taken from a humidity sensor in physical communication with fluid entering the evaporator; (3) utilizing a measurement taken from a second temperature sensor in thermal communication with fluid exiting the evaporator; (4) utilizing a measurement taken from a pressure sensor in physical communication with fluid exiting the evaporator (5) utilizing a measurement taken from a pressure sensor in physical communication with fluid exiting the condenser; (6) utilizing a measurement taken from a first temperature sensor in thermal communication with fluid exiting the condenser; (7) utilizing a measurement taken from a second temperature sensor in thermal communication with fluid entering the condenser; (8) utilizing a measurement taken from a voltage sensor in electrical communication with a power supply to the system; (9) utilizing a measurement taken from a current sensor in electrical communication with a power supply to the system; (10) utilizing a measurement taken from a flow sensor in fluid communication with fluid entering the expansion device; (11) utilizing a measurement taken from a bubble fraction sensor in fluid communication with fluid entering the expansion device; and (12) utilizing a measurement taken from a temperature sensor in fluid communication with fluid exiting the system.

The method may include the step of repeating the step of proceeding through the iteration of the plurality of operating parameters at predetermined time intervals.

The method of maximizing the measured efficiency of an air conditioner or a heat pump system having a condenser, an evaporator, a compressor, and an expansion device may include the steps of (1) providing a plurality of operating parameters selected from the group consisting of evaporator fan speed and condenser fan speed; (2) calculating an initial efficiency of the system using signals received from a plurality of components selected from the group consisting of a temperature sensor, a humidity sensor, a pressure sensor, a flow sensor, a voltage sensor, and a current sensor; (3) proceeding, starting with a first operating parameter as an active operating parameter having an initial active operating parameter value, to (a) adjust the active operating parameter value to a new operating parameter value, (b) calculate a measured efficiency of the system, (c) compare the initial efficiency of the system to the measured efficiency of the system, and (d) proceed in an iterative manner only if the measured efficiency of the system is improved beyond a predetermined threshold with the measured efficiency of the system acting as an initial efficiency for the next iteration and a next operating parameter acting as the active operating parameter in the next iteration.

The method may further include the step of providing a plurality of operating parameters selected from the group consisting of evaporator fan speed, condenser fan speed, inlet solenoid valve position, and outlet solenoid valve position.

The method may further include the steps of (1) adjusting the active operating parameter value in an opposite direction to the new operating parameter value if the measured efficiency of the system is not improved; (2) calculating the measured efficiency of the system; and (3) reverting the active operating parameter value to the initial active operating parameter value if the measured efficiency of the system is decreased.

The method of maximizing the measured efficiency of an air conditioner or a heat pump system having a condenser, an evaporator, a compressor, and an expansion device with fluid traveling through the system may include the steps of (1) providing an evaporator fan speed output having a evaporator fan speed output value equal to a first evaporator fan speed output value; (2) providing a first condenser fan speed output having a condenser fan speed output value equal to a first condenser fan speed output value; (3) calculating an initial efficiency of the system using signals received from a plurality of components selected from the group consisting of a temperature sensor, a humidity sensor, a pressure sensor, a flow sensor, a voltage sensor, and a current sensor wherein each of the plurality of components are fixedly coupled to the system; (4) adjusting the evaporator fan speed output value in a first direction; (5) waiting for a stabilization period; (6) calculating a first measured efficiency of the system using signals received from the plurality of components; (7) comparing the initial efficiency of the system to the first measured efficiency of the system to determine a first efficiency differential; (8) determining whether the first efficiency differential is negative or positive; (9) adjusting the first evaporator fan speed output value in an opposite direction if the first efficiency differential is negative; (10) waiting for the stabilization period if the first efficiency differential is negative; (11) calculating a second measured efficiency of the system using signals received from the plurality of components if the first efficiency differential is negative; (12) comparing the second measured efficiency of the system to the initial efficiency of the system to determine a second efficiency differential if the first efficiency differential is negative; (13) determining whether the second efficiency differential is negative or positive if the first efficiency differential is negative; (14) adjusting the evaporator fan speed output value to the first evaporator fan speed output value if the second efficiency differential is decreased; (15) adjusting the first condenser fan speed output value in a first direction and setting the initial efficiency to the first measured efficiency if the first efficiency differential is positive; (16) adjusting the first condenser fan speed output value in the first direction and setting the initial efficiency to the second measure efficiency if second efficiency differential is positive; (17) waiting for a stabilization period; (18) calculating a third measured efficiency of the system using signals received from the plurality of components; (19) comparing the initial efficiency of the system to the third measured efficiency of the system to determine a third efficiency differential; (20) determining whether the third efficiency differential is negative or positive; (21) adjusting the first condenser fan speed output value in an opposite direction when the third efficiency differential is negative; (22) waiting for the stabilization period; (23) calculating a fourth measured efficiency of the system using signals received from the plurality of components; (24) comparing the fourth measured efficiency of the system to the initial efficiency of the system to determine a fourth efficiency differential; (25) determining whether the fourth efficiency differential is negative or positive; and (26) adjusting the condenser fan speed output value to the first condenser fan speed output value when the fourth efficiency differential is negative.

DETAILED DESCRIPTION OF THE INVENTION

Figure 1:
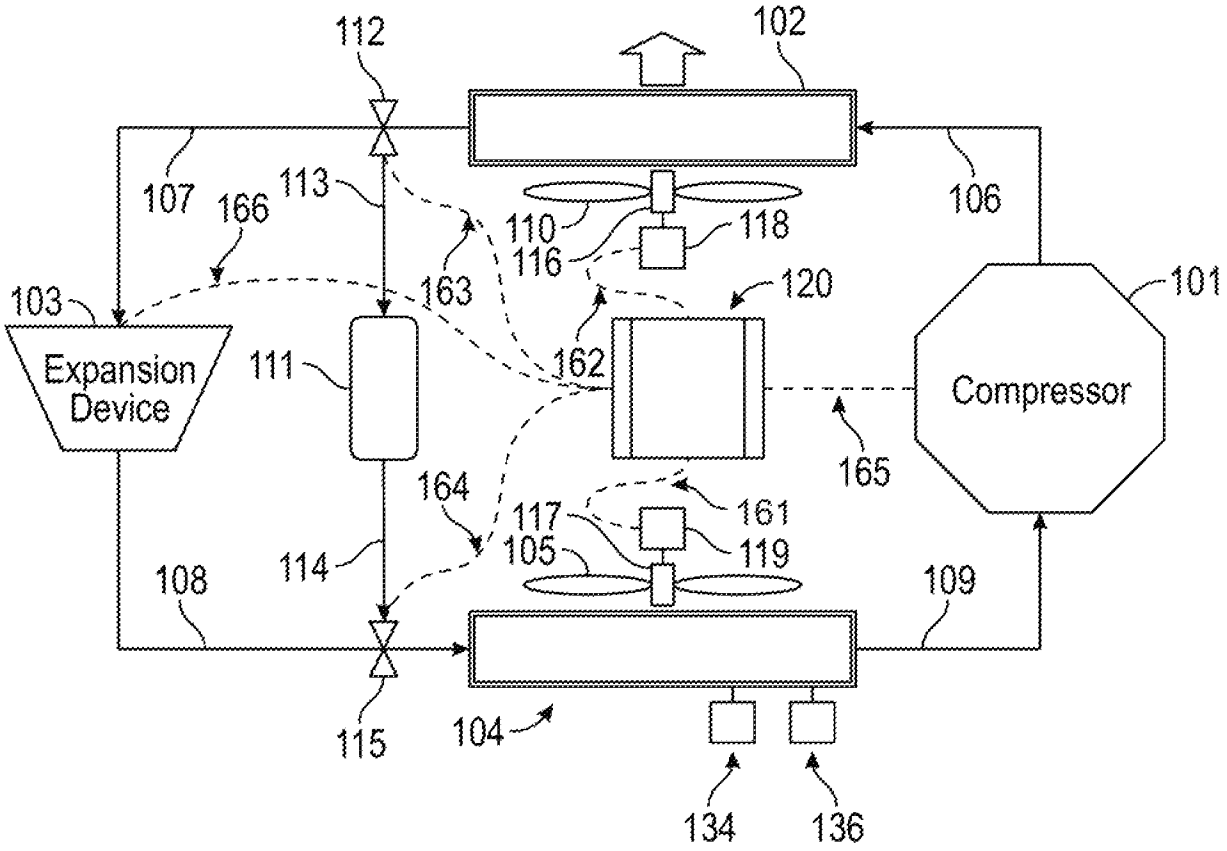
FIG. 1 depicts a block diagram an air-conditioning, refrigeration, or heat pump system in combination with the efficiency optimization system in accordance with an embodiment of the invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides an efficiency optimization system 100 for adjusting a heating, ventilation, air conditioning, or refrigeration (HVAC&R) system for the purpose of maximizing measured energy efficiency ratio (EER), coefficient of performance (COP), integrated energy efficiency ratio (IEER), or seasonal energy efficiency ratio (SEER). The EER, COP, IEER, or SEER may be a measured efficiency. The efficiency optimization system 100 utilizes a feedback loop to optimize cooling or heating capacity relative to power consumed.

The efficiency optimization system 100 may calculate a first measured efficiency. The measurement may provide an absolute, realistic, and continuous assessment of operational efficiency. The system 100 may then adjust one or more operating parameters of the HVAC&R system and calculate a second measured efficiency. The comparison between the first and second measured efficiencies may determine adjustments to one or more operating parameters to maximize the measured efficiency.

Calculating the measure efficiency of HVAC&R systems operating on a vapor compression cycle is difficult, particularly when operating in a field environment rather than a test laboratory. An accurate heat absorption or heat rejection measurement for these systems is quite complex and requires measurement of the mass flow rate of fluid through the heat exchanger along with enthalpies entering and leaving the heat exchanger.

The efficiency optimization system 100 performs this calculation with a controller 120 adapted to receive input from a plurality of sensors located within an HVAC&R system. Based upon the value of the measured efficiency, the controller 120 provides control signals to operating parameters in the HVAC&R system. The controller 120 may include an analog to digital converter 151 and a processor 153.

Figure 2:
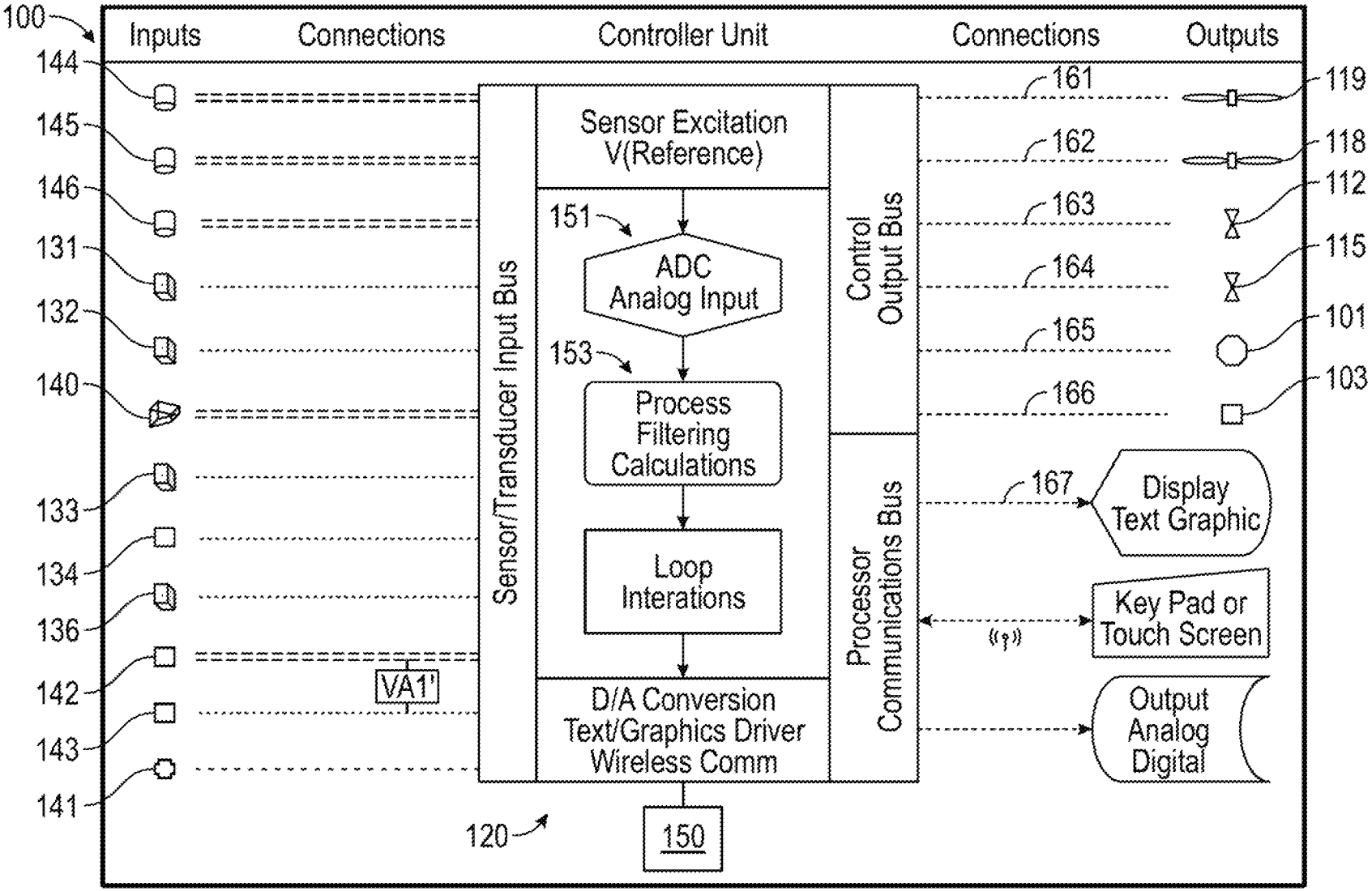
FIG. 2 depicts a block diagram of the efficiency optimization system in combination with controlled components of the air-conditioning, refrigeration, or heat pump system in accordance with an embodiment of the invention.

As shown in FIG. 2, the controller 120 may be adapted to receive inputs from a plurality of sensors. Sensors may include a first temperature sensor 131, a second temperature sensor 132, a third temperature sensor 133, a fourth temperature sensor 134, a humidity sensor 136, a bubble fraction sensor 141, a power voltage sensor 142, a power current sensor 143, a first pressure sensor 144, a second pressure sensor 145, a third pressure sensor 146, and a flow sensor 140.

The third temperature sensor 133, fourth temperature sensor 134, and humidity sensor 136 may be optional and required only if the system outputs EER, IEER, or COP in accordance with ANSII AHRI Standard 340/360 test conditions. The fourth temperature sensor 134 and the humidity sensor 136 may be combined in a single package. The fourth temperature sensor 134 may be a resistance temperature detector or other device responsive to temperature. The humidity sensor 136 may be a thin-film capacitor, other device responsive to air relative humidity. The humidity sensor 136 and the fourth temperature sensor 134 may output signals ranging between 0 and 5 VDC and proportional to temperature or humidity. The fourth temperature sensor 134 and the humidity sensor 136 may be located in thermal and fluid communication, respectively, with an inlet to an evaporator 104, which is part of the HVAC&R system for which efficiency is being measured.

Signals output from the fourth temperature sensor 134 and the humidity sensor 136 may be in electrical communication with analog input on the controller 120 and provided to an analog to digital converter 151. In one embodiment, the analog to digital converter 151 may be packaged separately from other components in the controller 120. In other embodiments, the analog to digital converter 151 may be packaged along with other controller 120 components. The signals from the sensors may be connected to an analog input on the controller 120 through a wired or wireless connection, including, but not limited to, a 2.4 GHz IEEE 802.15.x RF wireless transmission or similar connection. Excitation voltage may be provided from a power supply 150 to the fourth temperature sensor 134, the humidity sensor 136, or any other active sensor within the efficiency optimization system 100.

An external flow sensor 140 may include one or more working fluid flow thermal sensors and may be adapted to measure the temperature of the working fluid flow through refrigerant tubing. In some embodiments, the external flow sensor 140 may include an ultrasonic flow sensor, a Doppler transit-time sensor, other sensor responsive to refrigerant mass, volume flow rate or velocity, a turbine, a vortex, a magnetic sensor, or the like. The external flow sensor 140 may include two pressure sensors adapted to measure differential pressure across a venturi or across a section of smaller diameter tubing.

In some embodiments, an optional bubble fraction sensor 141 may be used. The bubble fraction sensor 141 may output a DC signal proportional to the sensed volume fraction of working fluid in vapor form within the liquid form of the working fluid. The output signal of the bubble fraction sensor 141 may range from 0-5 VDC. Excitation voltage from the power supply 150 may be provided for the bubble fraction sensor 141.

A power voltage sensor 142 may be in electrical communication with the HVAC&R system 100 power supply. The power voltage sensor 142 may be adapted to measure the voltage of power consumed by one or more elements of the HVAC&R system. The power voltage sensor 142 may physically connect to the HVAC&R system power supply using a pair of standard alligator-type spring-clip probes directly attached to a power line and the neutral or ground line if the equipment is single-phase. The power voltage sensor 142 may physically connect to two line power phases if the equipment is three-phase. Other configurations that are known in the art may also be suitable to measure the voltage of power consumed by the HVAC&R system.

A power current sensor 143 may be in electrical communication with an HVAC&R system power supply. The power current sensor 143 may be adapted to measure the current consumed by one or more elements of the HVAC&R system. The current voltage sensor 143 may physically connect to the HVAC&R system power supply using a split-core or solid core clamp-on type current probe attached around an insulated line power phase conductor, or the like. The power current sensor 143 may sense current and transform it by a scaling ratio into a low current signal for input to the controller 120. In one embodiment, the scaling ratio may be 1000:1.

Output signals from the power voltage sensor 142 and the power current sensor 143 may be connected to the controller 120. The controller 120 may utilized these signals to calculate power consumed by the HVAC&R system. In one embodiment, a power transducer may be in electrical communication with an HVAC&R system power supply. The power transducer may be adapted to measure the power consumed by one or more elements of the HVAC&R system. The power transducer may sense current and voltage and send a signal to the controller 120 indicative of the power consumed by one or more components of the HVAC&R system. The output signal of the power transducer may range from 0-5 VDC.

Each temperature sensor 131, 132, 133, 134 may be a type-K chromel/alumel thermocouple, a resistance temperature detector, liquid temperature sensor, vapor temperature sensor, a thermistor, or the like. Each temperature sensor 131, 132, 133, 134 may produce an output signal indicative of a measured temperature value. The output signal may range between 0.0 mV at 0 Celsius and 4.096 mV at 100 Celsius. Each temperature sensor 131, 132, 133, 134 may be secured to a clamp-on probe and adapted to measure a temperature at a thermocouple junction embedded in the clamp-on probe. The clamp-on probe may be adapted to form a thermal connection with refrigerant tubing. A signal from the thermocouple junction may be transmitted along a chromel/alumel insulated conductor to an analog thermocouple input. An IC-compensated thermocouple input circuit, or the like, may receive this signal and convert the signal to an output signal indicative of the measured temperature at the sensor location. The output signal may range from 0-5 VAC.

The pressure sensors 144, 145, 146 may have microelectric mechanical system strain-gauge sensing elements chemically compatible with refrigerants and refrigerant oils. The pressure sensors 144, 145, 146 may be adapted to be in fluid communication with refrigerant tubing. Excitation voltage may be provided by the power supply 150 for the pressure sensors 144, 145, and 146.

The power supply 150 may provide an excitation voltage for one or more efficiency optimization system 100 components. In one embodiment, excitation voltage may be provided by a power conditioning circuit.

In one embodiment, the controller 120, may be mounted inside of a housing 149. A first refrigerant pressure hose 147 may be secured to the first pressure sensor 144 and a second refrigerant pressure hose 148 may be secured to the second pressure sensor 145. Each of the first and second refrigerant pressure hoses 147, 148 may be terminated with standard Schrader fittings or other fitting adapted to form an pressure tight seal. The first and second refrigerant pressure hoses 147, 148 may be adapted to form an airtight fluid passageway to the first and second pressure sensors 144, 145, respectively. The fittings on the first and second refrigerant pressure hoses 147, 148 may be secured to an air conditioner, refrigerator, or heat pump refrigerant service valve, or otherwise secured to refrigerant tubing at a location at which pressure measurements will be taken.

In one embodiment, refrigerant pressure hoses 147, 148 may not be utilized to physically connect the housing 149 to the location within the HVAC&R system at which pressure is measured. In such an embodiment, one or more pressure sensors 144, 145, 146 may be connected directly or indirectly to a measurement location and may provide an electrical signal to the controller 120 using a wired or wireless connection.

The efficiency optimization system 100 may have a power supply 150. The power supply 150 may provide current and voltage to one or more active components in the efficiency optimization system 100. In one embodiment, the power supply 150 may be a dual output power supply with an input of 110-230 VAC and outputs of 12 VDC and 5 VDC. In one embodiment, the power supply 150 may include one or more batteries. In such an embodiment, the power supply 150 may be six rechargeable 2100mAH 1.2 Volt nickel-metal hydride (NiMH) batteries.

The controller 120 may include an analog to digital converter 151. The analog to digital converter 151 may be a general purpose 16-bit multi-channel analog to digital converter, or the like. The analog to digital converter 151 may be adapted to receive unipolar single-ended inputs with an external reference voltage. The analog to digital converter 151 may be adapted receive signals output from a sensor ranging between 0 to 5 VDC. The signals may be conditioned before received by the analog to digital converter 151. The analog to digital converter 151 may be integrated into a package with a processor, may be a separate package, or circuit. The analog to digital converter 151 may be mounted on a printed circuit board. The analog to digital converter 151 may sequentially convert each analog sensor input signal from the DC range to a binary value. This conversion may enable mathematical manipulation by drivers and program code executed by the controller 120.

The printed circuit board may also carry a bus header and a field header. The field header may be adapted to electrically connect the signals received from various sensors in the efficiency optimization system 100 to the controller 120. The bus header may be adapted to electrically connect outputs from the controller 120 to various operating parameters in the system.

The controller 120 may include a processor 153. The processor 153 may be adapted to interface with flash, RAM, and EEPROM memory. The processor 153 may implement a synchronous SPI serial interface and dual RS232/485 ports. The controller 120 may be adapted to accept user input received from a keypad or other input device and display data visually. Input to and output from the controller 120 may be implemented using wired or wireless methods, including, but not limited to, IEEE 802.11 standards. The controller 120 may execute analog to digital converter and digital to analog converter drivers and compiled ANSI-standard C program code that filters out-of-range values and perform the calculations corresponding to the flowcharts in FIGS. 7&8. Output values from the controller 120 may be converted to analog signals by a digital to analog converter. The digital to analog converter may be a 12-bit multi-channel digital to analog converter.

The efficiency optimization system 100 may include a visual display, which may be an LCD or the like. The display may be controlled using a wired or wireless connection. The system may be in wired or wireless communication with a personal device. The personal device may include, but is not limited to, a tablet computer, laptop computer, desktop workstation, phone, or the like. The personal device may be used to provide input to or receive output from the efficiency optimization system 100. The measured efficiency, cooling or heating being delivered, power consumed, or any other measured, stored, intermediate, or calculated value may be displayed on the visual display or provided to the personal device for display. The system 100 may also be in communication with a server, which may be located remotely. The system 100 and the server may be in communication via a wired or wireless interface, including, but not limited to, communication over a cellular system. Values measured by the system 100 may be stored on the server as well as on the system 100 or personal device. Calculations may be performed on the server.

The information to be displayed or provided for display may be configurably selected by a user. The user may interface with the efficiency optimization system 100 using a keypad or touch screen, either of which may be wired or wireless.

Block diagrams of an HVAC&R system in accordance with embodiments of the invention are shown in FIGS. 1, 3, 4, 5, and 6. Working fluid flows in the refrigerant tubing 106, 107, 108, 109, 113, 114 of the HVAC&R system, which is a sealed system in a closed circuit. A compressor 101, which may be hermetically sealed, open-drive, positive displacement, centrifugal or other type, a condenser heat exchanger coil 102, an expansion device 103, which may include, but is not limited to, a thermostatic expansion valve, an electronic expansion valve, a fixed orifice, a capillary tube, other flow control valve, or the like, and an evaporator heat exchanger coil 104 are included and in fluid communication within the closed HVAC&R system.

As working fluid flows through the closed system, the working fluid may change phase between gas, liquid, and a mixture of liquid and gas.

An evaporator fan 105, which may include, but is not limited to, a fan, pump, blower, or the like, may cause the medium that is to be cooled, which may be, but is not limited to, air or water, to flow through or over the evaporator heat exchange coil 104, where flowing liquid working fluid within the evaporator heat exchange coil 104 may absorb the heat from the medium and change the phase of the working fluid from liquid to vapor. Leaving the evaporator, the working fluid may flow through refrigerant tubing 109 to compressor 101.

The temperature of the medium to be cooled may be measured by the fourth temperature sensor 134 at or near the inlet of the evaporator heat exchange coil 104. In embodiments in which the medium is air, the relative humidity of the medium may be measured by the humidity sensor 136 at or near the inlet of the evaporator heat exchange coil 104.

Figure 3:
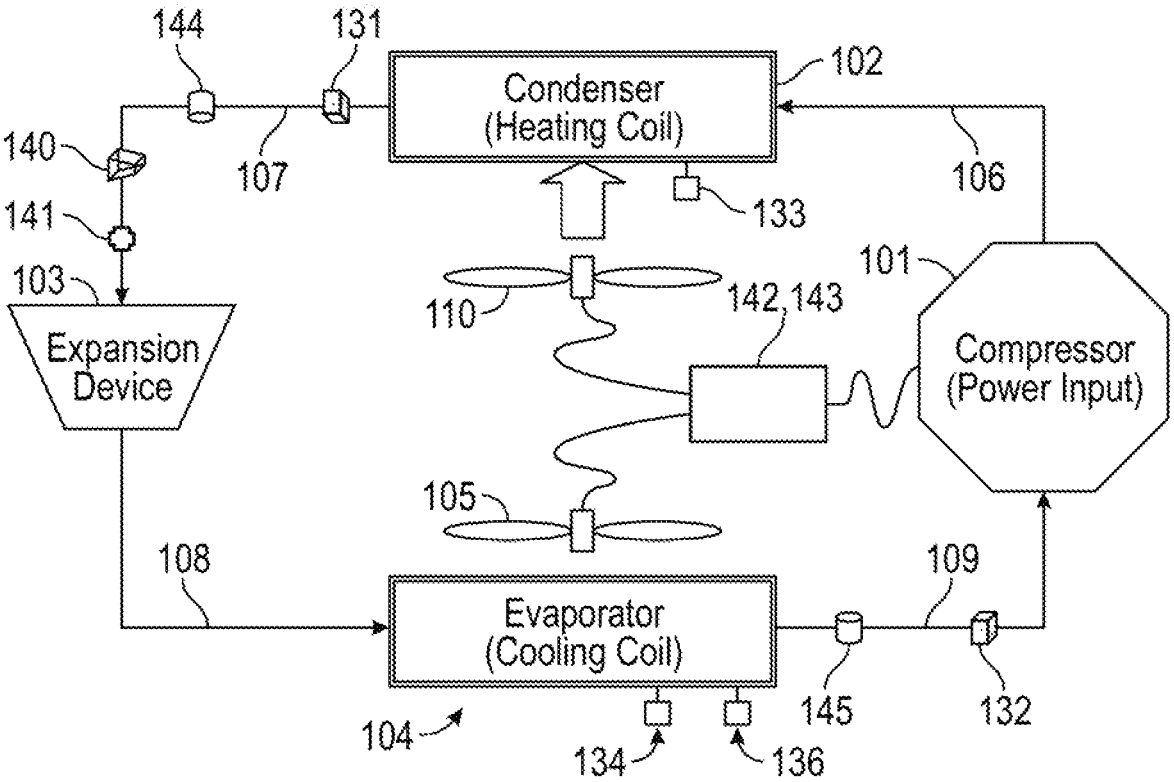
FIG. 3 depicts a block diagram of an air-conditioning or refrigeration system in combination with sensors of the efficiency optimization system in accordance with an embodiment of the invention.
Figure 4:
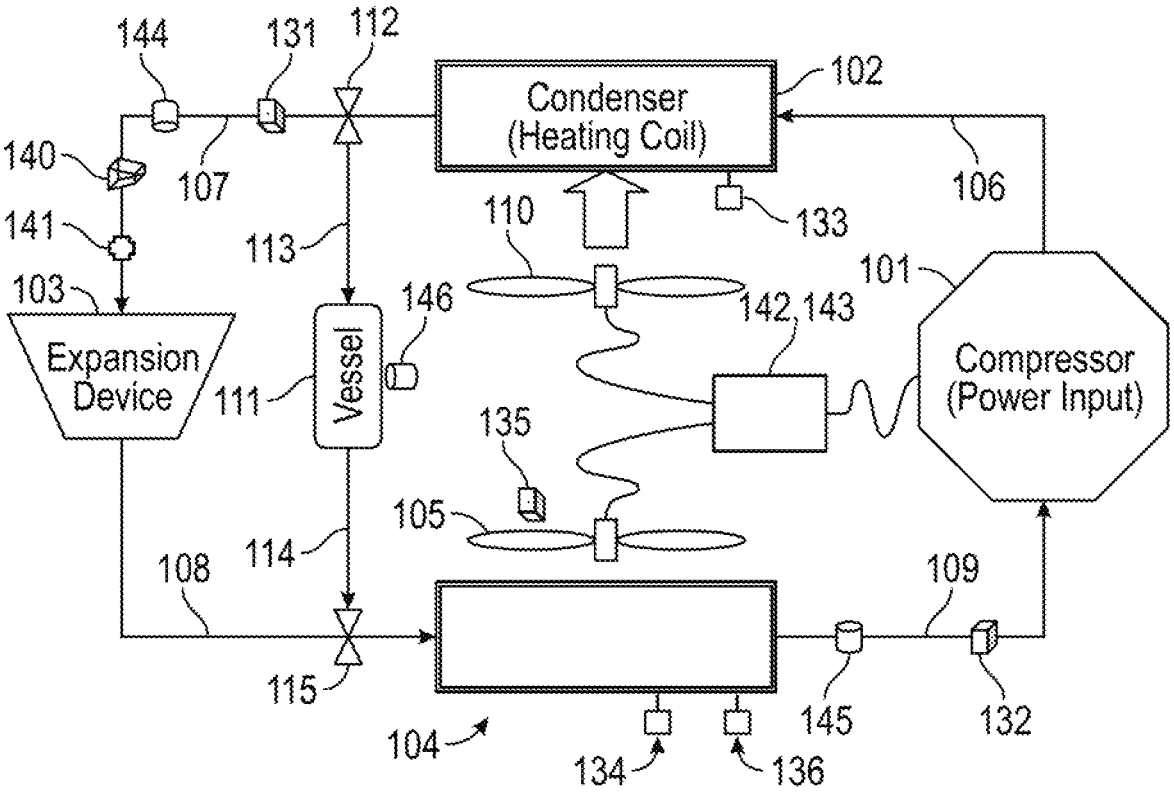
FIG. 4 depicts a block diagram of an air-conditioning or refrigeration system in combination with sensors of the efficiency optimization system in accordance with an embodiment of the invention.
Figure 5:
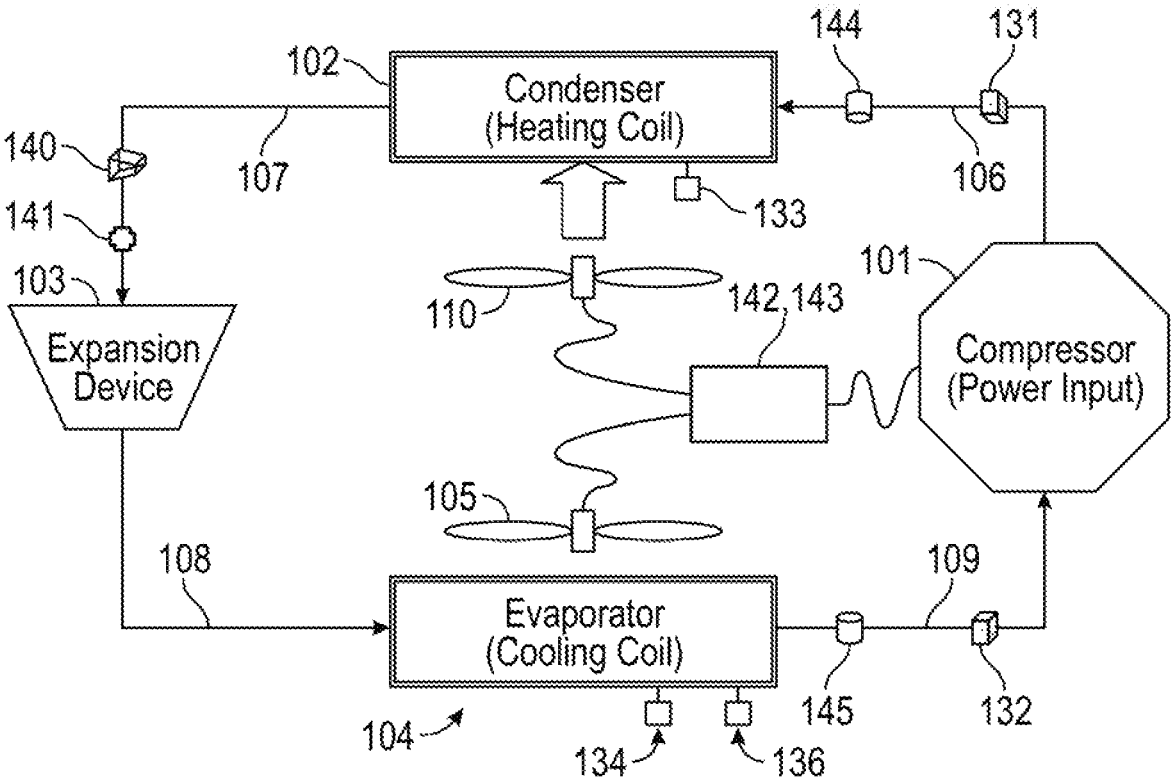
FIG. 5 depicts a block diagram of a heat pump system in combination with sensors of the efficiency optimization system in accordance with an embodiment of the invention.
Figure 6:
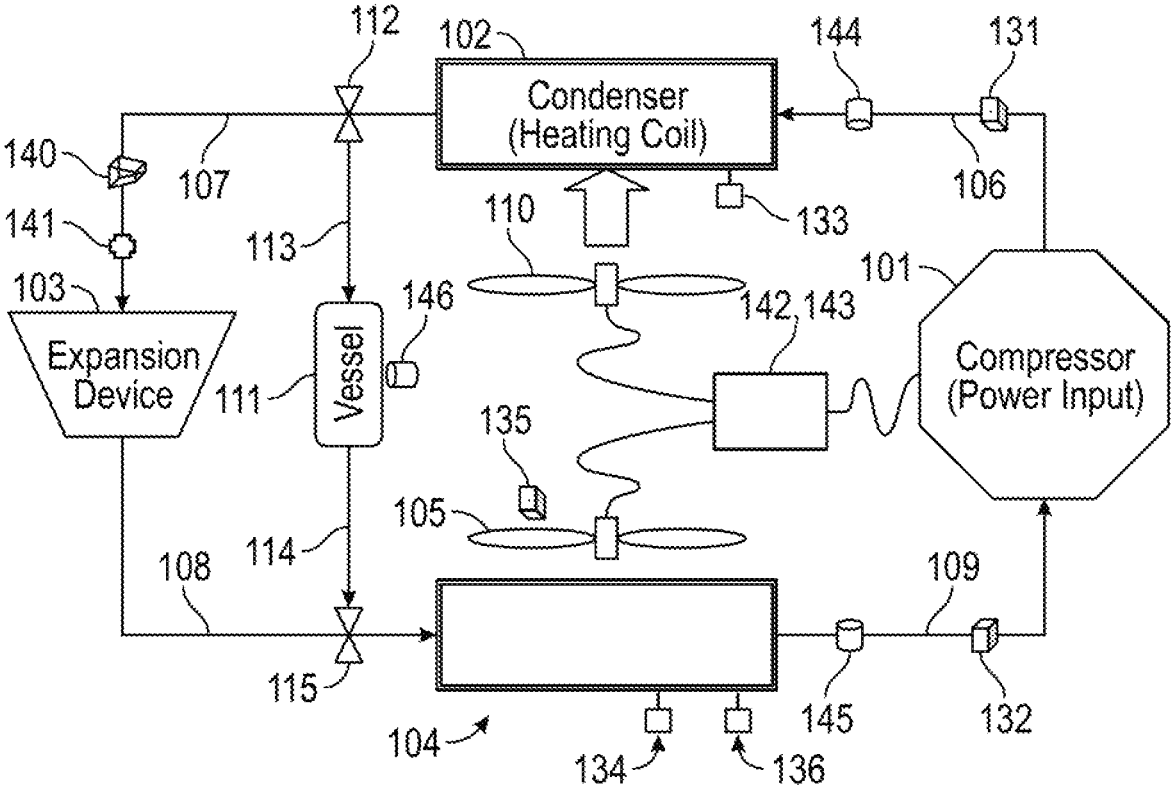
FIG. 6 depicts a block diagram of a heat pump system in combination with sensors of the efficiency optimization system in accordance with an embodiment of the invention.

In embodiments which may be used for air conditioning or refrigeration, as depicted in FIGS. 3 and 4, the temperature of the working fluid in refrigerant tubing 109 may be sensed by the second temperature sensor 132. In embodiments which may be used for heating, as depicted in FIGS. 5 and 6, the temperature of the working fluid in refrigerant tubing 106 may be sensed by the second temperature sensor 132.

The compressor 101 may be adapted to reduce the specific volume of the working fluid, which increases the pressure and temperature of the working fluid, which is then discharged from the compressor 101 as a superheated vapor or gas into refrigerant tubing 106, which carries the working fluid to the condenser 102. A condenser fan 110, which may include, but is not limited to, a fan, pump, blower, or the like, may cause the medium that is to be heated to flow through condenser heat exchange coil 102, where heat may be absorbed by the medium flowing through the condenser 102. Within the condenser 102, the working fluid may change phase from vapor to liquid. The liquid working fluid may flow out of the condenser 102 and into refrigerant tubing 107.

In air conditioning and refrigeration systems, the first temperature sensor 131 may measure the temperature of the working fluid within the refrigerant tubing 107. The refrigerant tubing 107 may carry the working fluid to the expansion device 103. The expansion device 103 may be an orifice, a thermostatic expansion valve, a capillary tube, an electronic expansion valve, a flow control valve, an expander, other type of expansion device, or the like as would be known to one skilled in the art.

In heating systems, the first temperature sensor 131 may measure the temperature of the working fluid within the refrigerant tubing 106 as the working fluid is carried from the compressor 101 outlet to the condenser 102 inlet.

Bubble fraction sensor 141 may optionally be used in the efficiency optimization system 100. When used, it may be mounted onto a liquid line sight glass and detect the presence of small amounts of working fluid in vapor form. The liquid line sight glass may be secured to and in-line with the refrigerant tubing 107. The flow rate of liquid working fluid flowing in refrigerant tubing 107 may be measured by a flow sensor 140, which may include, but is not limited to, a non-intrusive external flow sensor, thermal sensor, ultrasonic sensor, Doppler transit time sensor, other sensor responsive to refrigerant mass or volume flow rate or velocity, an intrusive sensor, turbine, vortex, magnetic sensor, or the like.

The temperature of the medium to be heated may be measure by the third temperature sensor 133, which may be located at the inlet of the condenser 102. As the working fluid passes through the expansion device 103 it may experience a decrease in pressure approximately equal to the increase in pressure driven by the compressor 101 minus any pressure losses created by the refrigerant tubing 106, 107, 108, 109 and heat exchanger 102, 104. The decrease in pressure may also cause the temperature of the working fluid to decrease and it may flow into refrigerant tubing 108 as a mixture of vapor and liquid. Refrigerant tubing 108 be adapted to carry the working fluid to the evaporator 104 to complete the cycle.

The pressure of the working fluid entering the expansion device 103 may be measured by a first pressure sensor 144 secured to and in fluid communication with a standard liquid-line service valve in fluid communication with refrigerant tubing 107. In some embodiments, no liquid-line service valve may be provided by the HVAC&R system. In such an embodiment, a compressor discharge service valve of the HVAC&R system may be utilized to measure the pressure of the working fluid between the compressor 101 discharge and the condenser 102 inlet. In such an embodiment, the first pressure sensor 144 may be in fluid communication with the refrigerant tubing 106. Either location of the first pressure sensor 144 may be acceptable. The controller 120 may perform different calculations to account for the location at which the first pressure sensor 144 is placed. In embodiments in which the first pressure sensor 144 is located between the compressor 101 discharge and the condenser 102 inlet rather than between the condenser 102 outlet and the expansion device 103, the calculation may be adjusted to account for pressure loss occurring in condenser 102, which may be quite small compared to the pressure rise across compressor 101 and the pressure loss across expansion device 103.

The pressure of the working fluid leaving the evaporator coil 104 may be measured by a second pressure sensor 145, which may be secured to and in fluid communication with a standard suction-line service valve of the HVAC&R system secured to and in fluid communication with the refrigerant tubing 109. Both the first pressure sensor 144 and the second pressure sensor 145 may be either directly attached to standard service valves, or secured to a length of flexible hose with Schrader or other fittings, which may be connected between the service valve and the sensors as convenience and accessibility of the system's existing service valves dictate.

The first pressure sensor 144 and second pressure sensor 145 may be micro-electric mechanical system strain-gauge type having a one piece stainless steel sensing element chemically compatible with refrigerants, refrigerant oils, or other pressure sensor known in the art.

The voltage and current of the electrical power driving compressor 101, condenser fan 110, evaporator fan 105, evaporator 104, or other components of the HVAC&R system may be measured by a power voltage sensor 142 or a power current sensor 143.

Figure 8:
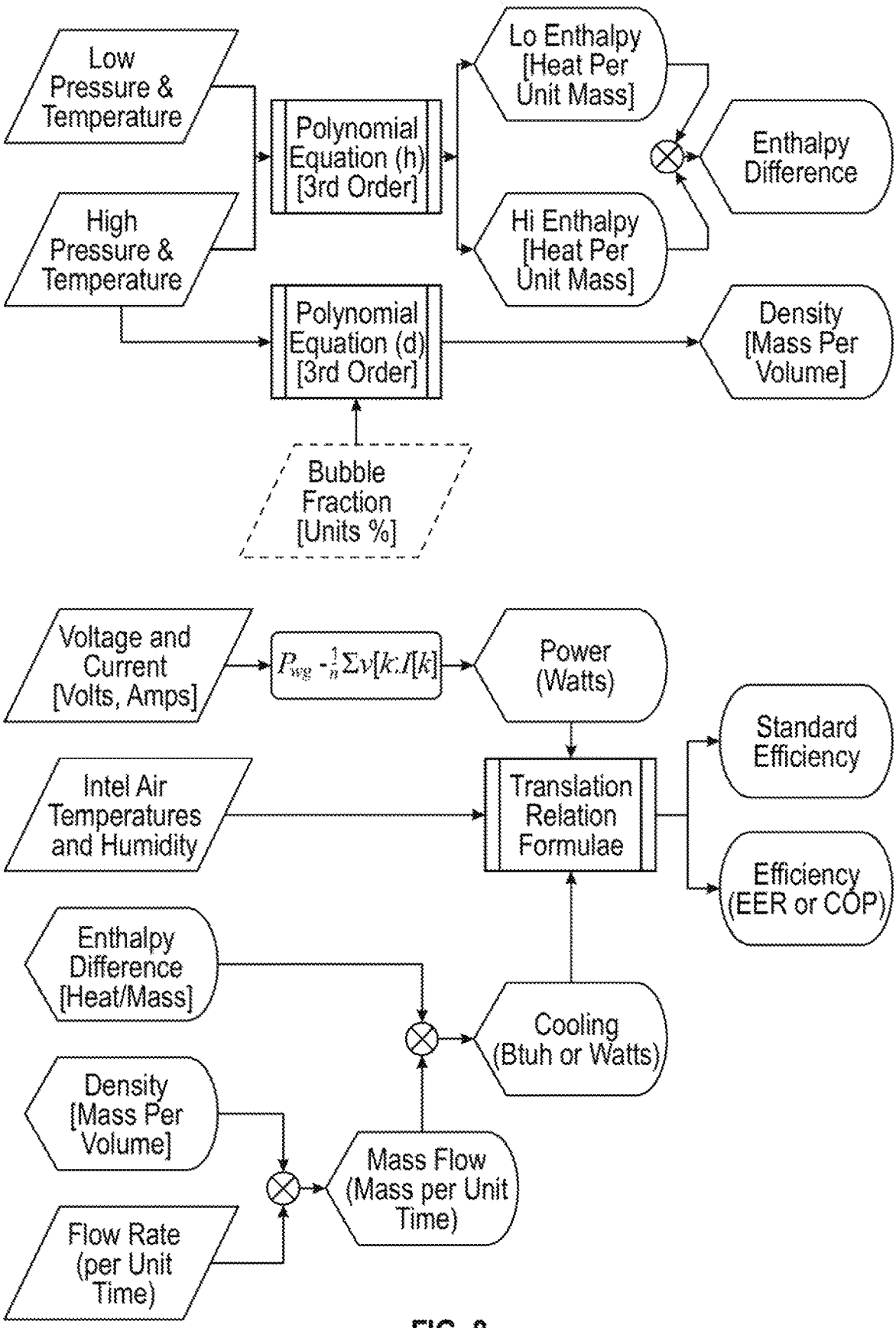
FIG. 8 depicts a flowchart of the method for determining measured efficiency of a heating, ventilation, air conditioning, or refrigeration system.

A flowchart of the steps of a method for determining the EER, COP, and intermediate values from data obtained via the efficiency optimization system 100 sensors and carried out by program code executed via the controller 120 in accordance with embodiments of the present invention is shown in FIG. 8. A first temperature measured by the first temperature sensor 131 and a first pressure measure by a first pressure sensor 144 may be the high pressure and high temperature values, respectively. A second temperature measured by a second temperature sensor 132 and a second pressure measured by a second pressure sensor 145 may be the low temperature and low pressure values, respectively. These two pressures and two temperatures are inputs to a set of polynomial equations. The polynomial equations may contain different constants dependent upon the type of HVAC&R system in use. In an embodiment in which R-22 is utilized in as the working fluid in an air conditioning or refrigeration system, the polynomials to be used may be:

$$STL=-0.0005*P^2+0.5418*P+12.43$$

where STL is the saturation temperature of the high pressure liquid in Fahrenheit degrees and P is high pressure value in pounds per square inch, $$STV=-0.0035*P^2+1.185*P-24.72$$

where STV is the saturation temperature of the low pressure vapor and P is the low pressure value in pounds per square inch. From these two equations, the liquid enthalpy can be determined using the following equation:

$$HL=-0.0000030(STL-\text{high temperature})^2+0.2937*STL-0.0001522(STL-\text{high temperature})+76.369$$

and the vapor enthalpy may be determined as:

$$HV=-3.17E-4*STV^2+4.4E-6(\text{low temperature}-STV)^2+0.1097*STV+2,655E-4(\text{low temperature}-STV)+171.263$$

The enthalpy difference may be:

$$dH_{cooling}=HL-HV,$$

which is in units of Btu/lb.

Other sets of constants in may be used in these equations for other working fluids, including, but not limited to, R-410a or other refrigerants. The constants may be obtained by linear regression, published refrigerant property relationships, or other ways known to one skilled in the art.

Other sets of polynomials, of the same form and with different constants, may be used for a heat pump in heating mode. In such an embodiment, the enthalpy difference may be $$dH_{heating}=HD-HL$$

where HD is the enthalpy of the condenser inlet gas sensed by the first pressure sensor 144 and the first temperature sensor 131 located between the compressor and condenser and may be calculated as:

$$HD=-3.17E-4*STD^2+4.4E-6(\text{discharge temperature}-STD)^2+0.1097*STD+2.655E-4(\text{discharge temperature}-STD)+171.263$$

where $$STD=-0.0011*P^2+0.8089*P-12.71$$

Other sets of polynomial coefficients, of the same form, may be stored as text files in the processor unit memory for common working fluids, which may include, but are not limited to, refrigerants R134A, R407A, R-410A, HFO-1234, R-513A, R-449A, R-452B, R-4220, R-502, or the like. Additional coefficients for working fluids may be input to the system as needed.

The polynomial equation $$D=-0.000222(\text{high temperature})^2-0.1027*\text{high temperature}+83.53$$

may be used to calculate the density in units of lb per cubic feet. Again, the constants used in the exemplary equation are appropriate values for systems using R-22 refrigerant as the working fluid. The density may be adjusted in embodiments utilizing a bubble fraction sensor 141, which may account for small amounts of vapor form of working fluid entrained in the liquid form of the working fluid. In an HVAC&R system properly charged and functioning, the liquid form of working fluid exiting the condenser may not contain any vapor form of the working fluid. The density D may also be calculated using published refrigerant property relationships, or in other ways known to one skilled in the art.

The density D may be multiplied by the volume flow rate measured by the flow sensor 140 to calculate the mass flow rate of working fluid in units of Ibm per minute. Multiplication of the mass flow rate of working fluid by the enthalpy difference, $dH_{cooling}$, may yield the measurement of cooling produced by the air conditioner or refrigerator in units of Btuh. This measurement may be converted to Watts using the factor 3.413 Btuh per Watt. Multiplication of the mass flow rate of refrigerant by the enthalpy difference $dH_{heating}$ may yield the measurement of heating produced by the heat pump in units of Btuh. This measurement may be converted to Watts using the factor 3,413 Btuh per Watt.

Rapidly sampled values of voltage and current values may be measured by the power voltage sensor 142 and the power current sensor 143, respectively. These values may be provided to the controller 120 and utilized to calculate real power in the digital domain, regardless of the harmonic content of the waveform, by a discrete summation of measure voltage and current over n time steps per cycle. The values must be measured over at least one waveform cycle. In some embodiments, the values may be measured over numerous waveform cycles. The result of the summation is a value of power usage, W, in units of Watts, where instantaneous measurements taken by the power voltage sensor 142 are in units of Volts and by the power current sensor 143 are in units of Amps.

In one embodiment, the power voltage sensor 142 and power current sensor 143 may be combined into a single power transducer sensor, which may output a signal indicative of Watts used by the system.

The cooling or heating measurement may be divided by the power measurement to obtain the EER for cooling or for heating or, with unit conversion, the COP, at the measured conditions. Values measured by the third temperature sensor 133, the fourth temperature sensor 134, or the humidity sensor 136, may be used in a translation relation. The measurement of the third temperature sensor 133 may be CTS. The measurement of the fourth temperature sensor 134 may be ETS. The evaporator air inlet wet bulb temperature may be calculated from the values sensed by the fourth temperature sensor 134 and the humidity sensor 136 and referred to as EWB. The translation relation may be utilized to obtain EER, IEER, or COP at accepted ANSII AHRI Standard 340/360 test conditions of measured temperature at the fourth temperature sensor 134 at 80° Fdb, measured humidity at the humidity sensor 136 of 67° Fwb, and measured temperature at the third temperature sensor 133 at 95°, 81.5°, 68°, and 65° Fdb. The exemplary translation relation assumes use of working fluid R-22 and may be:

$$tC=.005058*CTS-0.00537*TS-0.00426*ETS-.01484*EWB+1,379$$

$$tP=Pt*(STL'-STL)/(CS'-CS)$$

where CS=STL−CTS. tC may be the EER/IEER translation for cooling. tP may be the EER/IEER power translation. TS may the standard ambient test temperature value, CTS may be the condenser air inlet temperature measured by the third temperature sensor 133. Where STL and CS are calculated using the temperature and pressure values at which the measurement was taken and STL' and CS' are calculated using the temperature and pressure values of the standard to be converted to. Pt may be the power translation coefficient, which may be determined with artificially restricted condenser airflow to supply a measurement of STL' and CS' where W' is the standard wet bulb temperature to be translated to and $$Pt=(W'-W)/(STL'-STL)$$

The IEER may be calculated by the equation $$IEER=(0.020*A)+(0.617*B)+(0.238*C)+(0.125*D)$$

where the variables A, B, C and D are the EER translated to the conditions specified in ANSII/AHRI Standard 340/360 as would be known to one skilled in the art. Other sets of translation formulae coefficients, of the same form, may be stored as text files in the processor unit memory for HVAC&R systems with common working fluids, including, but not limited to, R134A, R407A, R-410A, HFO-1234, R-513A, R-449A, R-452B, R-422C, R-502, or the like. Coefficients corresponding to other refrigerants may be readily added as needed.

The measured efficiency may be affected by the load under which the HVAC&R system is running. The load is a function of the evaporating and condensing temperatures. An increase in evaporating temperature or decrease in condensing temperature will raise the measured efficiency. A decrease in evaporating temperature or increase in condensing temperature will reduce the measured efficiency.

The controller 120 may continuously make adjustments to any of the operating parameters of the HVAC&R system to maximize the measured efficiency. Operating parameters may include, but are not limited to, motor speeds of an evaporator fan, condenser fan, compressor fan, or other fan; temperature set points for air coming out of unit (i.e. discharge temperature), air coming off of the evaporator coil, the thermostat, or the like, actuator positions of the damper directing air to the condenser, the damper directing air to the system intake, or the like; valve positions affecting the amount of refrigerant circulating in the system, or the like. The controller 120 may continually optimize one or more of these values as conditions change. Conditions that may change may include, but are not limited to, ambient temperature, return air dry or wet bulb temperature, ventilation load, condensing pressure, cooling load, heating load, or the like. The operating parameters may be adjusted by the controller 120 so that efficiency is as high as possible within the physical constraints of the system and the operating conditions.

One embodiment of the efficiency optimization system 100 may be a device mounted to an existing HVAC&R system. In another embodiment, the efficiency optimization system 100 may be integrated into an HVAC&R system. In yet another embodiment, the efficiency optimization system 100 may be an embedded control sequence program in a building automation system or energy management system.

In any embodiment, accurate, direct, standard EER or COP measurements may be clearly displayed, along with optional diagnostic messages identifying out of range values. This output may allow a technician to immediately determine the operating efficiency of the system.

The sensor data may be utilized to calculate the difference between the heat content of the refrigerant at the entrance and exit of the evaporator heat exchange coil 104 or of the condenser 102 and the HVAC&R system or compressor 101 power demand. The measured efficiency may be calculated as the rate of heat transport at the evaporator 104 for cooling or at the condenser 102 for heating, divided by the real power input to the HVAC&R system and may be provided in units of Btuh per Watt. This calculated value may be provided to a display and as an analog or digital signal that may utilized in a feedback control loop.

In a similar manner, COP may be calculated as the rate of heat transport divided by the real power input to the compressor 101 and provided as a unitless number to a display as an analog or digital signal. The cooling or the heating being delivered and the power consumed may also be displayed or transmitted as an analog or digital signal, as can any of the other measured, stored, intermediate, or calculated parameters within the efficiency optimization system 100.

The measured efficiency may be repeatedly calculated by the controller 120 at pre-defined time intervals, random intervals, or as directed by a user. Operating parameters of the HVAC&R system may be iteratively adjusted by changing output values of the controller 120 between or during efficiency measurements. The adjustment direction of any operating parameter, which may include, but is not limited to, an increase or decrease, along with a relative magnitude of the adjustment direction, may be calculated according to measured conditions and a log of previous values stored in memory or on the server. Subsequent iterations of adjusting operating parameters may be followed by an efficiency measurement after the system has stabilized and comparison of the most recent efficiency measurement with the previous efficiency measurement. The resulting change in efficiency may be evaluated as either positive, insignificant, negative, or the like. A positive change in efficiency may result in iteration of the next operating parameter. A negative change in efficiency may result in re-adjustment of the operating parameter most recently changed. After a number of iterations, which number may be predetermined or configurable and be as small as 0, or if the change in efficiency is less than a threshold value, which may be predetermined or configurable, the next operating parameter may be adjusted regardless of the efficiency changes obtained by changing the current operating parameter. The iteration sequence may be continued until all operating parameters have been adjusted to achieve the maximum efficiency, and the process may repeat, starting with the first operating parameter. In this way, the maximum efficiency is continuously achieved by incrementally adjusting each operating parameter to realize an incremental increase in efficiency, even as conditions such as ambient temperature, cooling load, or the like are changing.

A schematic representation of an HVAC&R system showing the connections from the output of the efficiency optimization system 100 to components that are controlled to adjust system operating parameters is shown in FIG. 1. The controller 120 may generate voltage output signals proportional to operating parameter settings that maximize the efficiency of the system as load and operating conditions vary.

Voltage output and input signals between the controller 120 and sensors read by the efficiency optimization system 100 and HVAC&R components controlled by the efficiency optimization system 100 are shown in a block diagram in FIG. 2. First voltage output signal 161 may be in electrical communication with an evaporator fan motor speed control 119 and adapted to control the evaporator fan motor speed. The evaporator fan motor speed control 119 may be a variable frequency drive, electronically commutated motor, or the like, which may vary the speed of evaporator fan motor 117 driving evaporator fan 105.

Second voltage output signal 162 may be in electrical communication with a condenser fan motor speed control 118 and adapted to control the condenser fan motor speed.

The condenser fan motor speed control 118 may be a variable frequency drive, electrically commutated motor speed control, or the like, which may vary the speed of condenser fan motor 116 driving condenser fan 110.

The third voltage output signal 163 and the fourth voltage output signal 164 may be in electrical communication with a first refrigerant solenoid valve 112 and a second refrigerant solenoid valve 115, respectively, and adapted to control the aperture of the respective valves. Opening the first refrigerant solenoid valve 112 may allow the working fluid to flow into vessel 111. Opening the second refrigerant solenoid valve 115 may allow the working fluid to flow out of vessel 111.

The fifth voltage output signal 165 may be in electrical communication with the compressor 101 and adapted to control the operation of the compressor 101.

The sixth voltage output signal 166 may be in electrical communication with the expansion device 103 and adapted to control the operation of the expansion device 103.

The controller 120 may provide one or more of the first voltage output signal 161, second voltage output signal 162, third voltage output signal 163, fourth voltage output signal 164, fifth voltage output signal 165, or sixth voltage output signal 166 to adjust operating parameters of the air conditioner, refrigerator, or heat pump illustrated in FIG. 1.

The first voltage output signal 161 and the second voltage output signal 162 may range from 0-10 VDC and be proportional to the numerical set points of the speed of the evaporator fan 105 variable frequency drive or condenser fan 110 electronically commutated motor, or other motor speed control which responds to an input signal to achieve a desired motor speed, respectively.

The third voltage output signal 163 and fourth voltage output signal 164 may be digital signals, which may be either high or low. In one embodiment, these signals may be either 0 VDC or 5 VDC. The third voltage output signal 163 and the fourth voltage output signal 164 may be in electrical communication either directly, or indirectly via a relay to a first refrigerant solenoid valve 112 and a second refrigerant solenoid valve 115, respectively.

The fifth voltage output signal 165 may be a digital signal which may be either high or law. In one embodiment, the signal may be either 0 VDC or 5 VDC. The fifth voltage output signal 165 may be adapted to be in electrical communication with a compressor contact, which is adapted to energize the compressor 101. In embodiments in which the compressor 101 is an inverter driven or variable speed compressor, the fifth voltage output signal 165 may range from 0 VDC to 10 VDC and may be proportional to the set point of the speed of the compressor 101.

The controller 120 may output one or more display signals 167 to drive a graphical display. The one or more display signals 167 may be in electrical communication with a display unit through a wired or wireless connection, which may include, but is not limited to an IEEE 802.11 protocol. The display unit may be a 256×256 pixel LCD display screen, 720×480 pixel LCD touchscreen, or the like.

FIGS. 1, 4, and 6 depict embodiments in which a refrigerant reservoir vessel 111 along with associated refrigerant tubing 113, 114, first refrigerant solenoid valve 112, and second refrigerant solenoid valve 115 are present. In such an embodiment, refrigerant may be made to flow from the closed circuit into refrigerant reservoir vessel 111, which is included in the sealed system, by opening first refrigerant solenoid valve 112, which may allow working fluid to flow from refrigerant tubing 107 into refrigerant tubing 113, which may be adapted to carry the working fluid to the vessel 111, where the working fluid may be stored.

Working fluid may also be made to flow into the closed circuit from vessel 111 by opening second refrigerant solenoid valve 115, which may allow the working fluid to flow from the vessel 111, through refrigerant tubing 14, which may be adapted to carry the working fluid to refrigerant tubing 108.

In response to an output signal from the controller 120, the first refrigerant solenoid valve 112 may be pulsed open to allow an amount of working fluid to exit the circuit by flowing from refrigerant tubing 107 to refrigerant tubing 113, where it may be further carried to and stored by the vessel 111. In response to an output signal from the controller 120, the second refrigerant solenoid valve 115 may be pulsed open to allow an amount of refrigerant to enter the circuit by flowing from the vessel 111, into refrigerant tubing 114 and further into refrigerant tubing 108. The pressure of the working fluid in vessel 111 may be measured by a third pressure sensor 146. The amount of working fluid in vessel 111 may be measured by a level sensor, force sensor, or the like.

Figure 7:
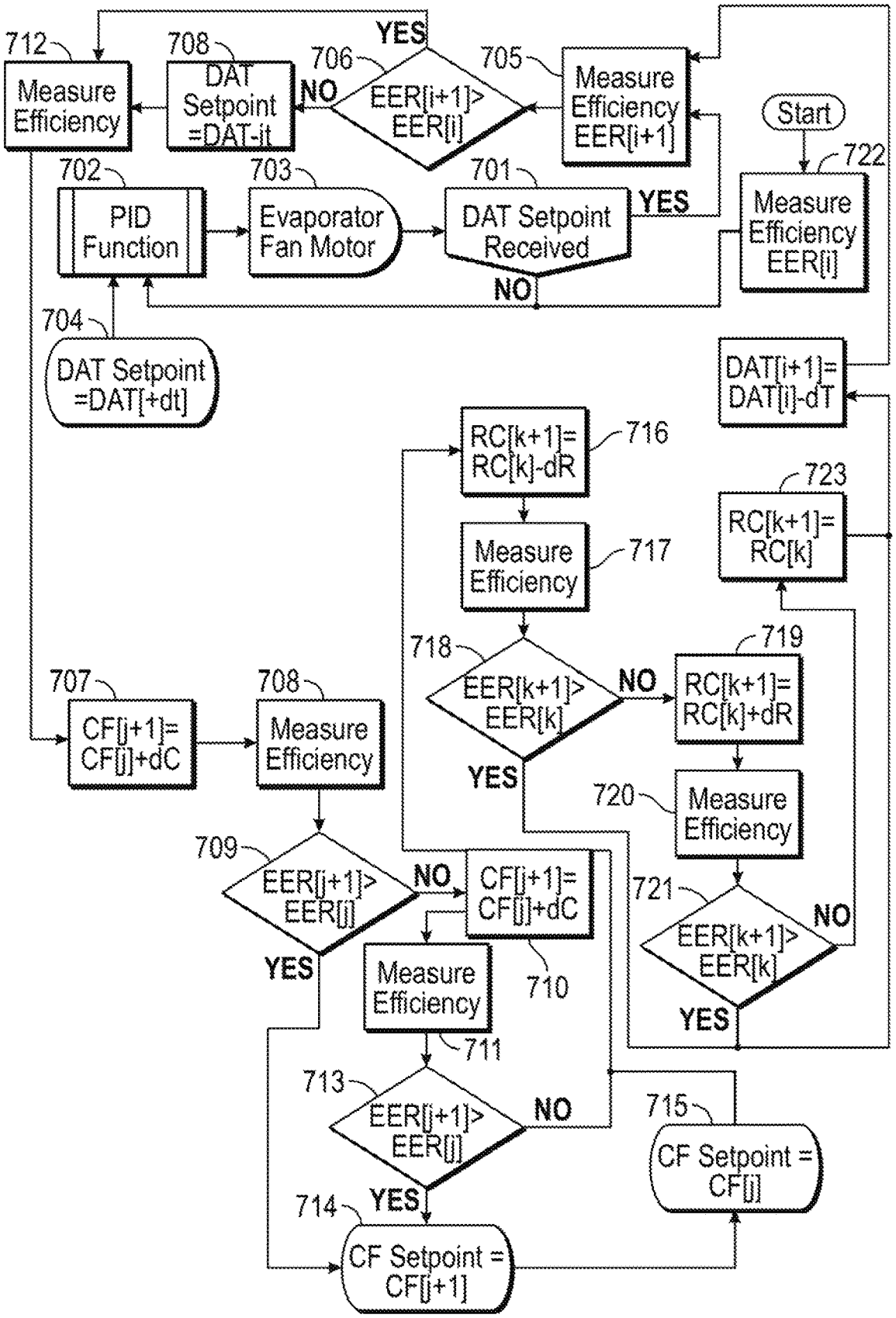
FIG. 7 depicts a flowchart of the method for determining the adjustment of the outputs of an embodiment having three operating parameters.

A flowchart of the steps of one embodiment of a method for determining the adjustment of the outputs of the system is depicted in FIG. 7. In this exemplary method, the efficiency optimization system 100 provides outputs for three adjustable operating parameters. Other embodiments may have a different number of adjustable operating parameters. There may be as few as one adjustable operating parameter with no upper limit to the number of possible operating parameters.

As depicted in the exemplary embodiment, an initial discharge air temperature set point may be provided to a proportional-integral-derivative (PID) control function 702, which may provide an output to control the evaporator fan motor speed, which will adjust the discharge air temperature (DAT) 703. The measured DAT may be provided as feedback to the PID function 702, the evaporator fan motor speed may be adjusted until the DAT set point is reached. The efficiency may be measured and stored in memory at time intervals. The intervals at which efficiency is measured may be predetermined, random, or configurable. The efficiency may be measured when a set point, desired operating parameter, or the like is achieved. When the DAT has reached a steady-state convergence value 701, the controller 120 may increment the DAT set point by the value dT 704, which for cooling may be determined by comparison of the load sensible heat ratio to the cooling coil sensible heat ratio. The load sensible heat ratio may be calculated by the ratio of the difference between the evaporator 104 intake temperature measured by the fourth temperature sensor 134 and the space temperature set point to the difference between the evaporator 104 intake absolute humidity calculated from the humidity sensor 136 and space absolute humidity set point calculated from the space temperature and humidity set points.

The cooling coil sensible heat ratio may be calculated by the ratio of the difference between the evaporator 104 intake temperature measured by the fourth temperature sensor 134 and the cooling coil saturation temperature to the difference between the absolute humidity calculated from the fourth temperature sensor 134 and the humidity sensor 136 and the saturated absolute humidity at the cooling coil saturation temperature, which may be calculated from the measured temperature of the second temperature sensor 132 and the measured pressure of the second pressure sensor 145 using formulas as would be known to one skilled in the art.

The DAT increment dT may be negative if the load sensible heat ratio is less than the cooling coil sensible heat ratio and positive if the cooling coil sensible heat ratio is less than the load sensible heat ratio. When the system has restabilized, either after a pre-defined stabilization period or after the DAT and efficiency measurement have reached convergence values, the efficiency may be measured 705. The newly measured efficiency may be compared to the efficiency measurement prior to the increment of DAT set point 706. If the efficiency measurement has increased, the controller 120 may proceed to adjust the next operating parameter to be iterated 707. If the efficiency measurement has decreased, the sign of dT may be changed, from positive to negative or from negative to positive or the DAT may be reverted to its previous value 708. In embodiments in which the sign of DAT is changed to find a new value of DAT, the evaporator fan motor speed may again be adjusted to reach the desired DAT and the efficiency measurements may again be compared after the system restabilizes. In some embodiments, any operating parameter may only be incremented a set number of times before the next operating parameter is adjusted. In other embodiments, an operating parameter may be adjusted a predetermined number of times unless an improvement is achieved. When increments to the DAT set point have concluded, the system may measure the efficiency 712 and advance to increment the next operating parameter.

In the exemplary embodiment depicted in FIG. 7, the condenser fan speed may be the next operating parameter to increment. The condenser fan speed may be incremented by a value dC 707. The efficiency may be measured 708 and compared to the most recently previously measured efficiency 709. If the newly measured efficiency is greater than the previously measured efficiency, the condenser fan speed set point may remain the value determined in step 707. If the newly measured efficiency is less than the previously measured efficiency, the condenser fan speed set point may be returned to its previous value or incremented in a different direction 710. The efficiency may again be measured 711 and compared to the efficiency of the system prior to the increment of the condenser fan speed 713. If the efficiency has increased the condenser fan speed set point may be retained as the incremented value 714. If efficiency has decreased, the condenser fan speed may be returned to its previous value 715.

The next operating parameter may then be incremented. In the exemplary embodiment, the amount of refrigerant in the system may be changed by the value dR 716. The amount of refrigerant in the value may be adjusted by opening one of two valves in the system. One valve may allow refrigerant to flow into the system. One valve may allow refrigerant to flow out of the system. The efficiency of the system may be measured 717 and compared to the previously measure efficiency 718. If the newly measured efficiency is greater than the previously measured efficiency, the refrigerant amount may remain the value determined in step 716. If the newly measured efficiency is less than the previously measured efficiency, the refrigerant amount set point may be returned to its previous value or incremented in a different direction 719. The efficiency may again be measured 720 and compared to the efficiency of the system prior to the increment of the condenser fan speed 721. If the efficiency has increased the refrigerant amount may be retained as the incremented value 716. If efficiency has decreased, the condenser fan speed may be returned to its previous value 723.

In embodiments in which there are no further operating parameters to adjustment, the controller 120 may return to initiate another DAT increment 722. If there are additional operating parameter adjustments, such as refrigerant composition, damper position, compressor speed, or others as would be known to one skilled in the art, the iteration sequence may be continued until all operating parameters have been adjusted to achieve a maximum, improved, or not decreased efficiency, and the controller 120 may repeat with the first operating parameter. In this way, the measured efficiency may be continuously increased by incrementally adjusting each operating parameter to realize an incremental increase in measured efficiency, even as conditions such as ambient temperature are changing.

Any operating parameters can be changed in any order and any number of parameters can be changed.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A method of maximizing the measured efficiency of an air conditioner or a heat pump system having a condenser, an evaporator, a compressor, and an expansion device, comprising the steps of:

providing a plurality of operating parameters selected from the group consisting of an evaporator fan speed, a condenser fan speed, a valve position, and a compressor control to the air conditioner or the heat pump system wherein each of the plurality of operating parameters has a respective first operating parameter value;

calculating an initial efficiency of the system using signals received from a plurality of components selected from the group consisting of a temperature sensor, a humidity sensor, a pressure sensor, a flow sensor, a voltage sensor, and a current sensor; and proceeding, starting with a first of the plurality of operating parameters as an active operating parameter having an initial active operating parameter value, to (1) adjust the initial active operating parameter value to form a new active operating parameter value, (2) calculate a measured efficiency of the system, (3) subtract the measured efficiency of the system from the initial efficiency of the system to calculate an efficiency differential, and (4) allow the new active operating parameter value to act as the initial operating parameter value if the efficiency differential is positive, and keeping the initial operating parameter value if the efficiency differential is negative.

2. The method of claim 1 further comprising the step of:

proceeding, in an iterative manner with the measured efficiency of the system acting as an initial efficiency for a successive iteration and a next of the plurality of operating parameters acting as the active operating parameter in the successive iteration until each of the plurality of operating parameters have been the active operating parameter.

3. The method of claim 1 further comprising the steps of:

calculating an active parameter differential by subtracting the new operating parameter value from the initial active operating value;

adjusting the new active operating parameter value by subtracting the active parameter differential from the initial active operating parameter to form a new operating parameter value calculating a second measured efficiency of the system;

subtracting the second measured efficiency of the system from the initial measured efficiency of the system to calculate a second efficiency differential:

allowing the second new active operating value to act as the initial operating parameter value if the efficiency differential is positive; and keeping the initial active operating parameter value if the second efficiency differential is negative.

4. The method of claim 1 further comprising the step of:

repeating the step of proceeding through the iteration of the plurality of operating parameters at predetermined time intervals.

5. A method of maximizing the measured efficiency of an air conditioner or a heat pump system having a condenser, an evaporator, a compressor, and an expansion device, comprising the steps of:

providing an evaporator fan speed output having an evaporator fan speed output value equal to a first evaporator fan speed output value;

providing a first condenser fan speed output having a condenser fan speed output value equal to a first condenser fan speed output value;

calculating an initial efficiency of the system using signals received from a plurality of components selected from the group consisting of a temperature sensor, a humidity sensor, a pressure sensor, a flow sensor, a voltage sensor, and a current sensor, wherein each of the plurality of components are fixedly coupled to the system;

adjusting the evaporator fan speed output value in a first direction;

calculating a first measured efficiency of the system using signals received from the plurality of components;

subtracting the first measured efficiency of the system from the initial efficiency of the system to calculate a first efficiency differential;

determining whether the first efficiency differential is negative or positive;

adjusting the first evaporator fan speed output value in an opposite direction if the first efficiency differential is negative;

calculating a second measured efficiency of the system using signals received from the plurality of components if the first efficiency differential is negative;

subtracting the second measured efficiency of the system from the initial efficiency of the system to determine a second efficiency differential if the first efficiency differential is negative;

determining whether the second efficiency differential is negative or positive;

adjusting the evaporator fan speed output value to the first evaporator fan speed output value if the second efficiency differential is negative;

determining a current efficiency of the system and setting the initial efficiency to the current efficiency;

adjusting the first condenser fan speed output value in a first direction;

calculating a third measured efficiency of the system using signals received from the plurality of components;

subtracting the third measured efficiency from the initial efficiency of the system to calculate a third efficiency differential;

determining whether the third efficiency differential is negative or positive;

adjusting the first condenser fan speed output value in an opposite direction when the third efficiency differential is negative;

calculating a fourth measured efficiency of the system using signals received from the plurality of components if the third efficiency differential is negative;

subtracting the fourth measured efficiency of the system from the initial efficiency of the system to determine a fourth efficiency differential if the third efficiency differential is negative;

determining whether the fourth efficiency differential is negative or positive; and adjusting the condenser fan speed output value to the first condenser fan speed output value to the first condenser fan speed output value if the fourth efficiency differential is negative.

6. The method of claim 5 further comprising the steps of:

providing a first refrigerant valve adapted to add refrigerant to the system and a second refrigerant valve adapted to remove refrigerant from the system;

determining a current efficiency of the system and setting the initial efficiency to the current efficiency;

actuating the first refrigerant valve;

calculating a fifth measured efficiency of the system using signals received from the plurality of components;

subtracting the fifth measured efficiency from the initial efficiency of the system to calculate a fifth efficiency differential;

determining whether the fifth efficiency differential is negative or positive;

actuating the second refrigerant valve when the fifth efficiency differential is negative;

calculating a sixth measured efficiency of the system using signals received from the plurality of components if the fifth efficiency differential is negative;

subtracting the sixth measured efficiency of the system from the initial efficiency of the system to determine a sixth efficiency differential if the fifth efficiency differential is negative;

determining whether the sixth efficiency differential is negative or positive; and actuating the first refrigerant valve when the sixth efficiency differential is negative.

7. A method of maximizing the measured efficiency of an air conditioner or a heat pump system having a condenser, an evaporator, a compressor, and an expansion device, comprising the steps of:

providing a first condenser fan speed output having a condenser fan speed output value equal to a first condenser fan speed output value;

providing a first refrigerant valve adapted to add refrigerant to the system and a second refrigerant valve adapted to remove refrigerant from the system;

calculating an initial efficiency of the system using signals received from a plurality of components selected from the group consisting of a temperature sensor, a humidity sensor, a pressure sensor, a flow sensor, a voltage sensor, and a current sensor, wherein each of the plurality of components are fixedly coupled to the system;

adjusting the first condenser fan speed output value in a first direction;

calculating a first measured efficiency of the system using signals received from the plurality of components;

subtracting the first measured efficiency from the initial efficiency of the system to calculate a first efficiency differential;

determining whether the first efficiency differential is negative or positive;

adjusting the first condenser fan speed output value in an opposite direction when the first efficiency differential is negative;

calculating a second measured efficiency of the system using signals received from the plurality of components if the first efficiency differential is negative;

subtracting the second measured efficiency of the system from the initial efficiency of the system to determine a second efficiency differential if the first efficiency differential is negative;

determining whether the second efficiency differential is negative or positive; and adjusting the condenser fan speed output value to the first condenser fan speed output value if the second efficiency differential is negative;

determining a current efficiency of the system and setting the initial efficiency to the current efficiency;

actuating the first refrigerant valve;

calculating a third measured efficiency of the system using signals received from the plurality of components;

subtracting the third measured efficiency from the initial efficiency of the system to calculate a third efficiency differential;

determining whether the third efficiency differential is negative or positive;

actuating the second refrigerant valve when the third efficiency differential is negative;

calculating a fourth measured efficiency of the system using signals received from the plurality of components if the third efficiency differential is negative;

subtracting the fourth measured efficiency of the system from the initial efficiency of the system to determine a fourth efficiency differential if the third efficiency differential is negative;

determining whether the fourth efficiency differential is negative or positive; and actuating the first refrigerant valve when the fourth efficiency differential is negative.

8. The method of claim 7 further comprising the steps of:

providing an evaporator fan speed output having an evaporator fan speed output value equal to a first evaporator fan speed output value;

determining a current efficiency of the system and setting the initial efficiency to the current efficiency;

adjusting the evaporator fan speed output value in a first direction;

calculating a fifth measured efficiency of the system using signals received from the plurality of components;

subtracting the fifth measured efficiency of the system from the initial efficiency of the system to calculate a fifth efficiency differential;

determining whether the fifth efficiency differential is negative or positive;

adjusting the first evaporator fan speed output value in an opposite direction if the fifth efficiency differential is negative;

calculating a sixth measured efficiency of the system using signals received from the plurality of components if the fifth efficiency differential is negative;

subtracting the sixth measured efficiency of the system from the initial efficiency of the system to determine a sixth efficiency differential if the fifth efficiency differential is negative;

determining whether the sixth efficiency differential is negative or positive; and adjusting the evaporator fan speed output value to the first evaporator fan speed output value if the sixth efficiency differential is negative.

* * * * *